United States Patent [19]

Klöckner

[11] Patent Number: 4,586,270

[45] Date of Patent: May 6, 1986

[54] BED THICKNESS LEVELLING DEVICE FOR A COOLING COLUMN

[76] Inventor: Alfred Klöckner, Hirtscheider Str. 13, D-5239 Nistertal, Fed. Rep. of Germany

[21] Appl. No.: 674,925

[22] PCT Filed: Mar. 20, 1984

[86] PCT No.: PCT/EP84/00082

§ 371 Date: Nov. 19, 1984

§ 102(e) Date: Nov. 19, 1984

[30] Foreign Application Priority Data

Mar. 22, 1983 [DE] Fed. Rep. of Germany ..... 3310360

[51] Int. Cl.[4] ..... F26B 17/12

[52] U.S. Cl. ..... 34/173; 34/178; 432/108; 432/118

[58] Field of Search ..... 34/171, 172, 173, 178; 432/106, 108, 118

[56] References Cited

U.S. PATENT DOCUMENTS

| | | | |
|---|---|---|---|
| 273,767 | 3/1883 | Schroeder | 34/173 |
| 2,000,817 | 5/1935 | Bixby | 34/172 |
| 2,949,678 | 8/1960 | Anderson | 34/105 |
| 3,256,615 | 6/1966 | Denison et al. . | |
| 3,681,855 | 8/1972 | Weisselberg et al. | 34/173 |

FOREIGN PATENT DOCUMENTS

| | | | |
|---|---|---|---|
| 0044947 | 2/1982 | European Pat. Off. . | |
| 62526 | 5/1892 | Fed. Rep. of Germany . | |
| 1043132 | 11/1958 | Fed. Rep. of Germany . | |
| 960296 | 10/1949 | France . | |
| 295476 | 8/1928 | United Kingdom | 34/173 |

*Primary Examiner*—Larry I. Schwartz
*Attorney, Agent, or Firm*—Robbins & Laramie

[57] ABSTRACT

In a cooling column the feed material to be dried or cooled is intermittently transferred from any one sieve bottom to a subjacent sieve bottom as by tilting individual sectors of the respective sieve bottoms. As a result, the feed material comes to rest on the sieve bottoms with a non-uniform bed thickness, resulting in non-uniform drying or cooling, respectively, of the feed material. A substantially uniform bed thickness of the feed material on the sieve bottoms is therefore desirable. This is achieved by the invention by providing a levelling rod mounted in support means for oscillating movement about a stationary pivot axis and extending substantially transversely of the direction of movement of the feed material.

12 Claims, 6 Drawing Figures

A-B

A-B

E-F

BED THICKNESS LEVELLING DEVICE FOR A COOLING COLUMN

DESCRIPTION

Figure 1:
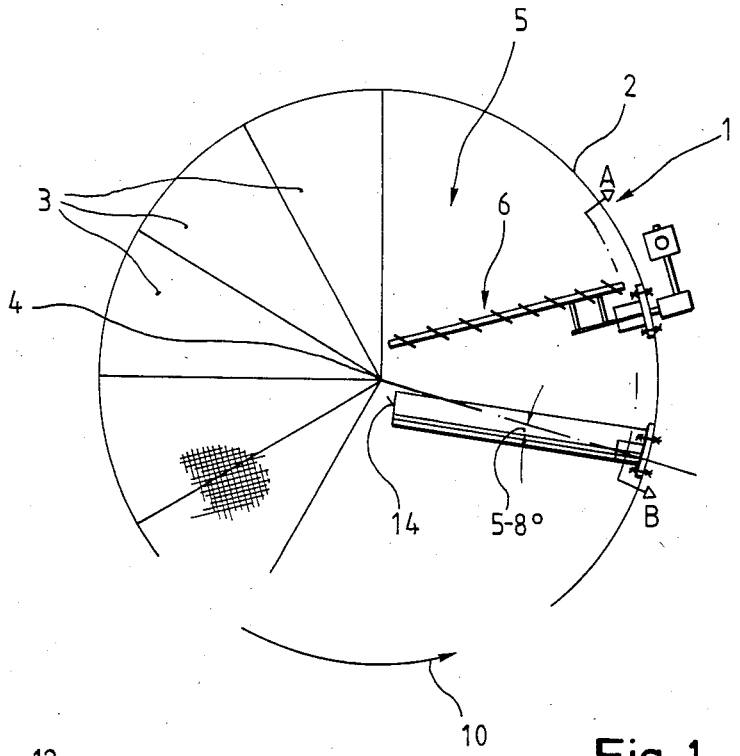

The present invention relates to a bed thickness levelling device for a cooling column, in which a feed material to be cooled or dried circulates on a plurality of sieve bottoms disposed one above the other and is intermittently transferred onto a respective subjacent sieve bottom.

A cooling column is an apparatus for cooling or drying a granular feed material, in which a plurality of sieve bottoms are mounted for rotation about a common axis within a substantially cylindrical upright housing. Each sieve bottom is divided into a plurality of circle-sector shaped sieve bottom sectors adapted to be tilted about an axis extending radially with respect to the common axis of rotation of the sieve bottom at a predetermined rotational position of the respective sieve bottom for transferring the feed material carried on the respective sieve bottom sector to the subjacent sieve bottom. The feed material to be treated is introduced into the cooling column adjacent the upper end thereof and proceeds along the plurality of sieve bottoms in the described manner to be finally discharged adjacent the lower end of the cooling column. Drying or cooling of the feed material is effected by means of a gas stream entering the cooling column at its lower end and leaving it at its upper end. During its flow through the cooling column, the gas stream passes through the individual sieve bottoms and the feed material carried thereon.

It has been found that a uniform bed thickness of the feed material on the individual sieve bottoms is of considerable importance. Varying bed thicknesses lead to a non-uniform pressure drop over the extent of the bed and thus to non-uniform flow velocities, resulting in a non-uniform heat exchange and thus to non-uniform cooling or drying of the granular feed material. Transfer of the feed material to a subjacent sieve bottom by tilting the sieve bottom sectors of the respective upper sieve bottom results in the formation of mounds of the feed material. A certain equalization is already brought about by a baffle plate located forward of the tilting position of the individual sieve bottom sectors with respect to the direction of rotation of the respective sieve bottom, as already proposed by the present applicant.

It is an object of the present invention to achieve a substantially uniform bed thickness of the feed material on the individual sieve bottoms of a cooling column of the type set forth in the introduction.

This object is attained according to the invention by providing a levelling rod mounted in support means for oscillating movement about a stationary pivot axis and extending substantially transversely of the direction of movement of the feed material.

A levelling rod of the type described permits in a simple manner a uniform distribution, and thus, a uniform bed thickness of the feed material to be treated on the respective sieve bottoms is achieved.

It has been found advantageous to employ a levelling rod in the form of a round bar or a tube section.

It has further been found that during conveyance on the individual sieve bottoms the feed material tends to migrate radially outwards on the respective sieve bottoms with respect to the axis of rotation thereof. In order to counteract this tendency and to thus achieve uniform distribution of the feed material in the radial direction of the sieve bottoms, it has been found advantageous to mount the levelling rod at such an orientation that in its operating position resting on said feed material, the end of the levelling rod facing towards the axis of rotation of the respective sieve bottom is offset relative to the radial direction of the sieve bottom in the direction of rotation thereof. A suitable offset angle of the levelling rod with respect to the radial direction has been found to be about 5° to 8°.

Uniformity of the bed thickness in the radial direction may be further promoted by providing a plurality of baffles mounted at spaced locations of the levelling rod, the baffles being preferably in the shape of annular discs. The uniformity of the bed thickness of the feed material in the radial direction may then be further promoted by providing that the planes of the baffles are inclined with respect to the travelling direction of the feed material on the sieve bottoms in a direction causing the feed material to be displaced radially inwards on passing the baffles.

The effectiveness of the levelling rod depends to a substantial degree on the weight of the levelling rod with which it rests on the feed material in relation to the granular structure of the feed material and the unit weight thereof. As a cooling column of the type described is conventionally used for treating feed materials having varying properties as to their granular structure and unit weight, it should be possible to vary the weight of the levelling rod resting on the feed material. In accordance with an advantageous embodiment of the invention this may be accomplished by providing a counterweight mounted for oscillating movement about the pivot axis of the levelling rod together therewith and permitting the pressure exerted by the levelling rod on the feed material to be adjusted. The counterweight is preferably mounted at an adjustable position permitting its moment of torsion about the pivot axis to be varied. For certain applications it is necessary either to increase or to reduce the pressure exerted by the levelling rod on the feed material. To this effect the counterweight may preferably be mounted on a lever arm adapted to be secured to the levelling rod mounting means at a variable angular position relative to the pivot axis. In this manner the counterweight may be used both for increasing and for reducing the pressure exerted by the levelling rod on the feed material.

To facilitate the adjustment of the counterweight, an advantageous embodiment of the invention provides that a stub aligned with the pivot axis of the levelling rod projects outwardly of the housing of the cooling column, and that the counterweight for adjusting the pressure exerted by the levelling rod on the feed material is secured to the stub.

For supplying an indication of the actual bed thickness, the stub may carry an indicator means connected thereto at the outside of the cooling column for indicating the actual position of the levelling rod and thus the effective bed thickness.

An additional equalizing effect on the bed thickness of the feed material particularly in the radial direction may further be achieved by providing that the end of the above mentioned baffle plate facing towards the axis of rotation of the sieve bottoms is offset relative to the radial direction by a predetermined angle opposite to the direction of rotation of the sieve bottoms. This angle is suitably selected to lie between about 5° and 8°.

Figure 2:
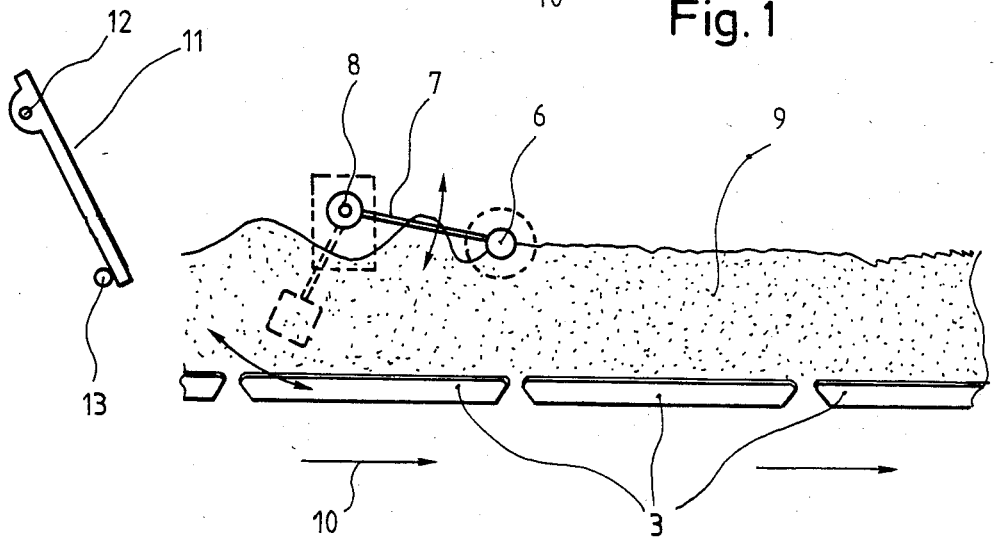
Figure 3:
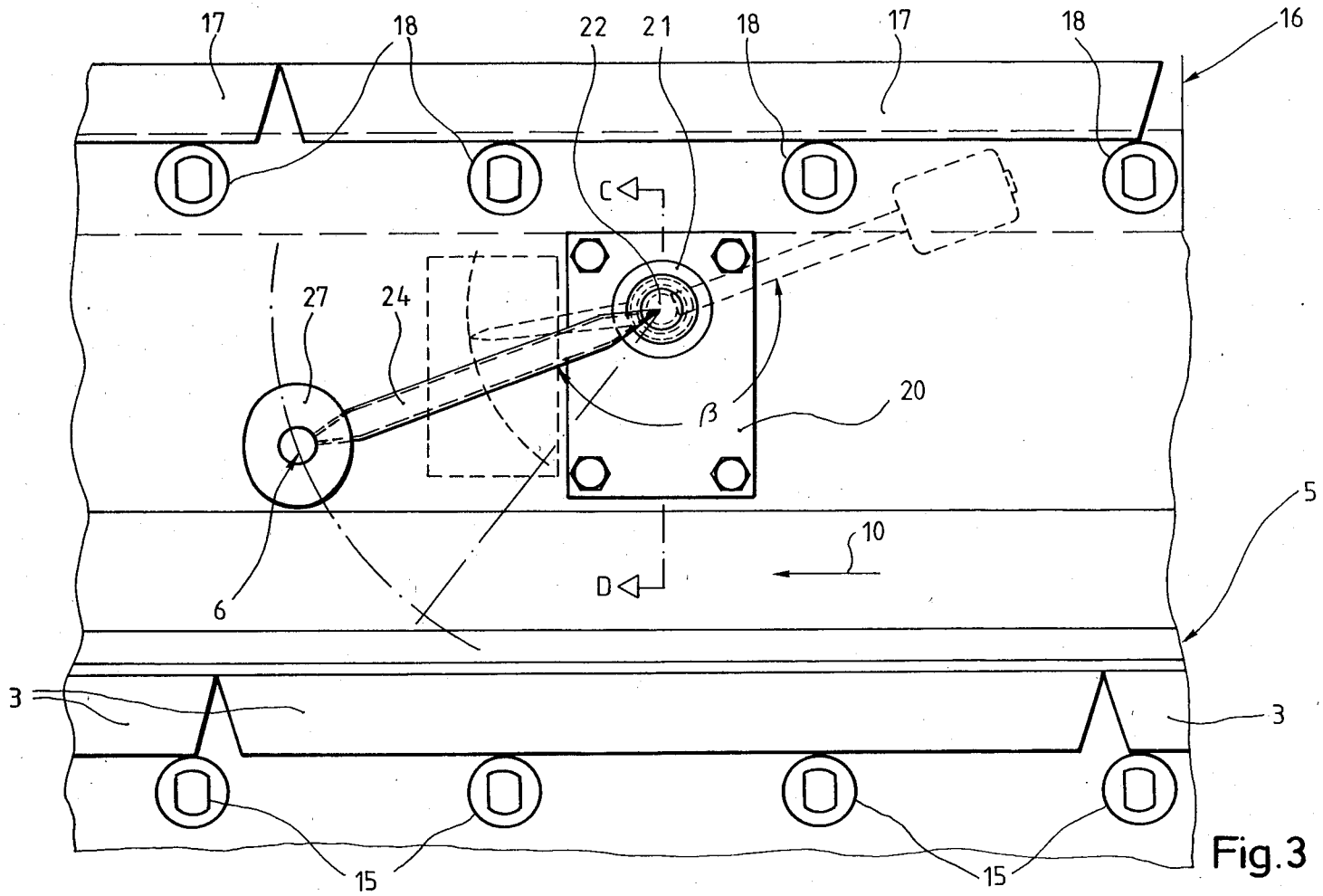
Figure 4:
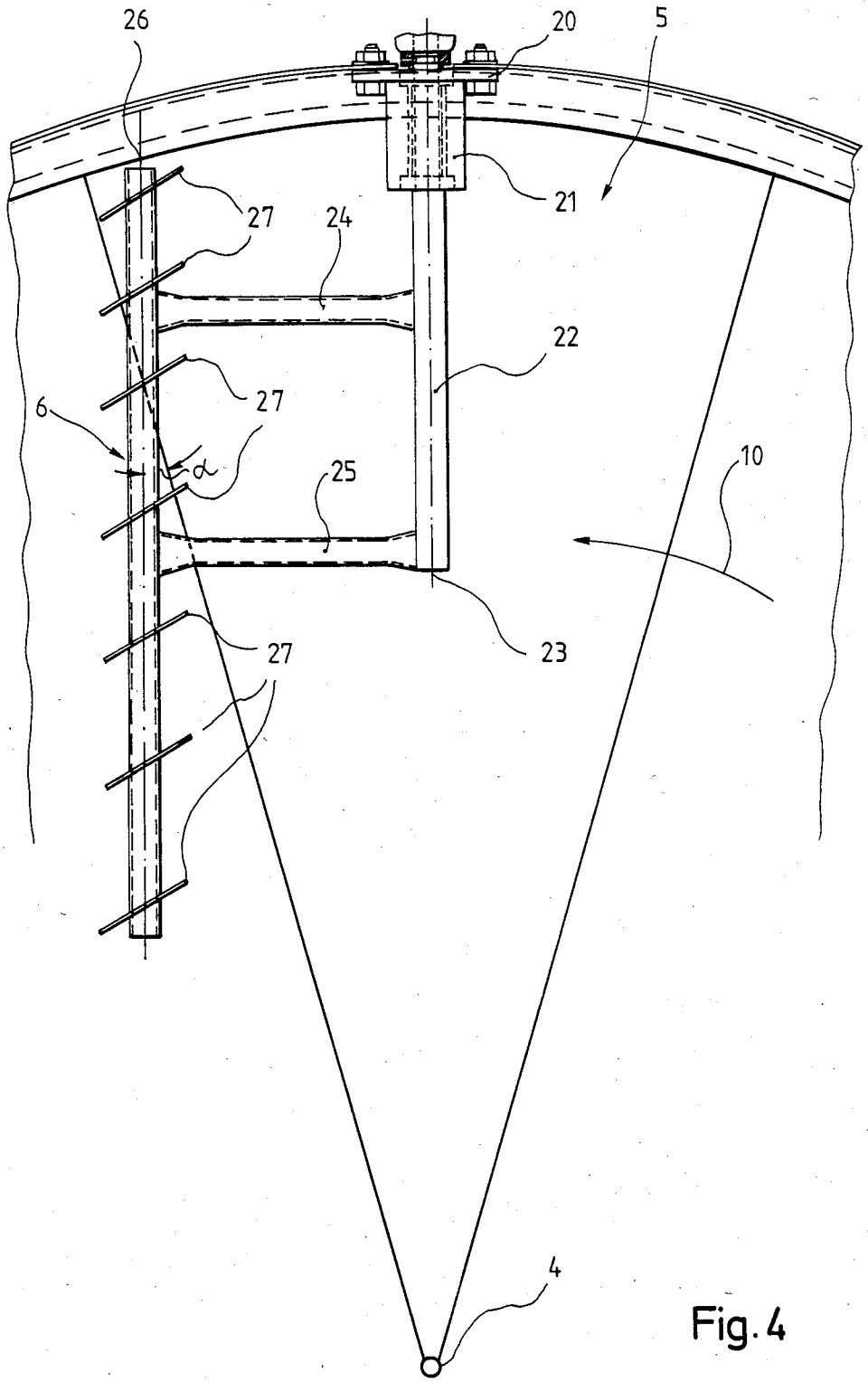
Figure 5:
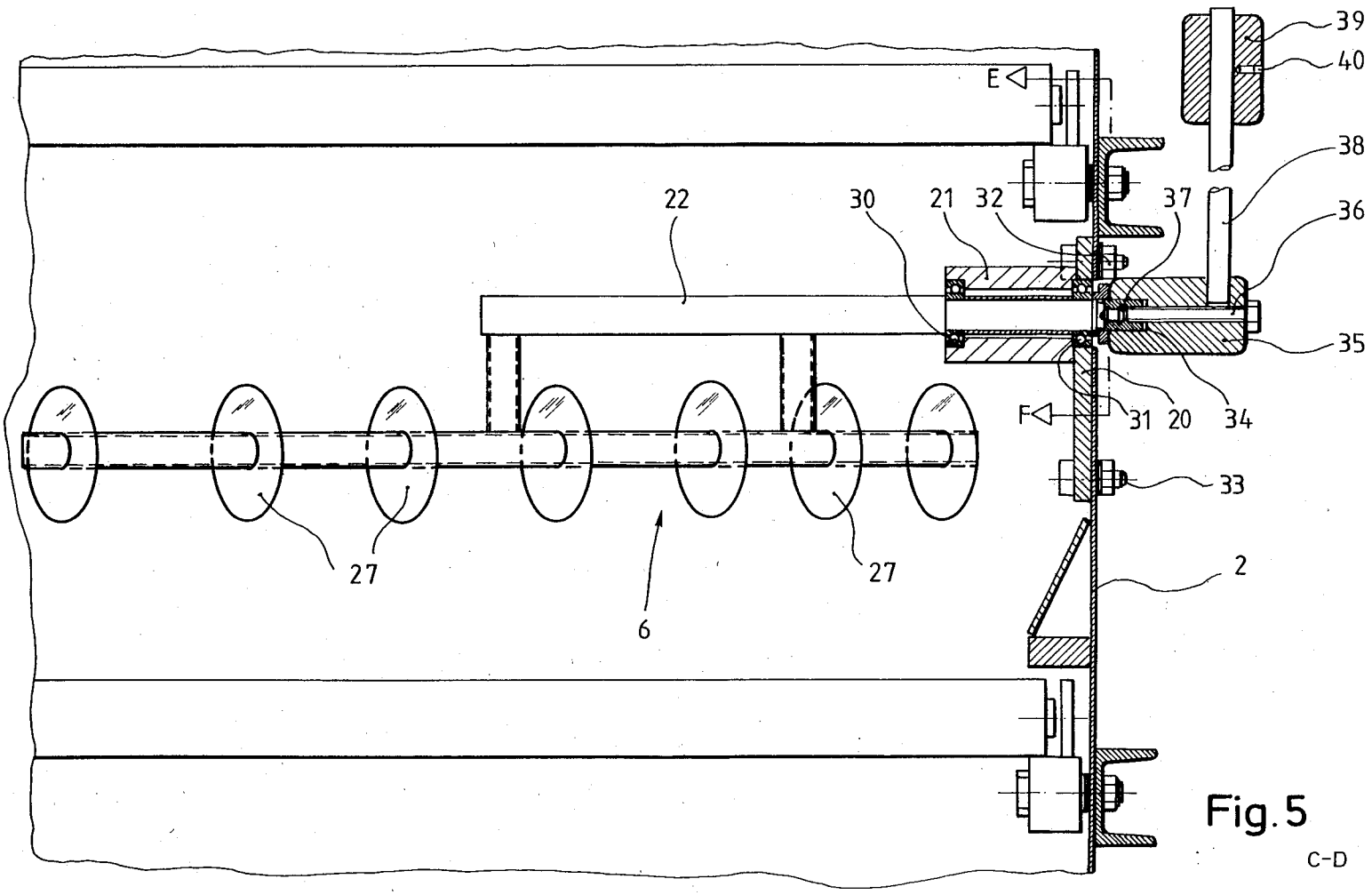
Figure 6:
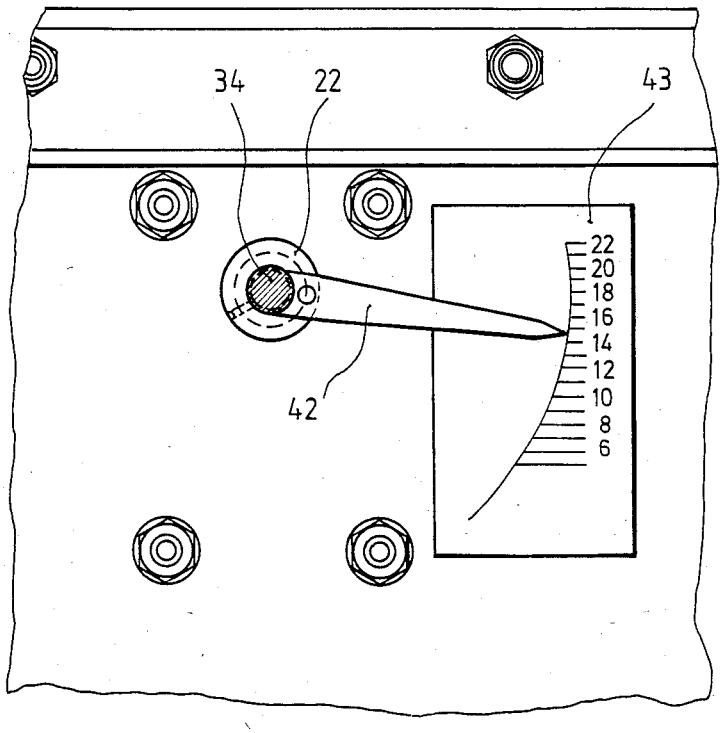

A preferred exemplary embodiment of the invention shall now be described in detail with reference to the accompanying drawings, wherein:

FIG. 1 shows a diagrammatic top plan view of a sieve bottom of a cooling column, with a levelling rod and a baffle plate being disposed thereabove, FIG. 2 shows a sectional view taken along the line A-B in FIG. 1 as seen from the interior, FIG. 3 shows a view of the levelling rod similar to that shown in FIG. 2, with the counterweight in another position, FIG. 4 shows a top plan view of the levelling rod as shown in FIG. 3, FIG. 5 shows a sectional view taken along the line C-D in FIG. 3, and FIG. 6 shows a sectional view taken along the line E-F in FIG. 5, FIGS. 1 and 2 show diagrammatic sectional views of a cooling column generally designated 1. A cylindrical housing 2 contains a plurality of sieve bottoms—only one of which is indicated at 5—mounted for rotation about a common axis 4. Sieve bottom 5 is divided into a plurality of identical circle-sector shaped sieve bottom sectors 3 only a few of which are shown in detail. Disposed above sieve bottom 5 is a levelling rod generally designated as 6 to be described in detail with particular reference to FIGS. 3 to 6. As most clearly shown in FIG. 2, levelling rod 6 is secured to a rod-shaped mounting means 7 mounted for oscillating movement about a pivot axis 8.

Levelling rod 6 rests on a feed material 9 carried by sieve bottom sectors 3 so as to level the surface of the feed material on rotation of the sieve bottom sectors 3 in the direction of arrow 10. During operation, levelling rod 6 is permitted to oscillate about pivot axis 8 so as to automatically adapt its position to a greater or smaller bed thickness of the feed material resulting from increased or reduced supply, respectively, of the feed material to the cooling column. As the levelling rod itself has a certain mass, it does not follow every unevenness on the upper surface of the feed material, so as to effect levelling of this surface due to its inertia.

A baffle plate 11 is mounted forward of the levelling rod 6 relative to direction of rotation 10 of sieve bottom 5 as shown in FIGS. 1 and 2. Baffle plate 11 serves the purpose of deflecting the feed material dropping from a sieve bottom (not shown) located above sieve bottom 5 upon tilting of the respective sieve bottom sectors thereof in the direction of rotation 10 of the sieve bottom. The tilted surface of the baffle plate simultaneously prevents the feed material from falling onto a sieve bottom sector 3 immediately forward of baffle plate 11 in the direction of rotation 10 and transfers the granular feed material carried thereon onto the subjacent sieve bottom. Baffle plate 11 is substantially formed as a flat plate mounted for oscillating movement about a substantially radially extending axis 12. Baffle plate 11 is retained in its normal position by engagement with a stop 13. As evident from FIG. 1, baffle plate axis 12 is preferably not aligned exactly in the radial direction with respect to the common axis of rotation 4 of the cooling column, but rather at an angle thereto, so that its end 14 facing towards axis of rotation 4 is offset from the radial direction opposite to the direction of rotation 10 of the sieve bottoms. The offset angle is preferably about 5° to 8°. As a result, the feed material dropping from the upper sieve bottom onto sieve bottom sectors 3 is distributed more evenly, as this offset orientation counteracts the tendency of the feed material to migrate outwards in a substantially radial direction.

Reference shall now be made to FIGS. 3 to 5 of the drawings. Diagrammatically shown in FIG. 3 is sieve bottom 5 with its sieve bottom sectors 3 resting on support rollers 15. Also shown is a sieve bottom 16 including sieve bottom sectors 17 disposed above sieve bottom 5. Sieve bottom sectors 17 rest on further support rollers 18. Secured to housing 2 is a mounting means 20 having a support bearing 21 for a shaft 22 srewably attached thereto. Shaft 22 is mounted in bearing 21 for oscillating movement about a pivot axis 23. Levelling rod 6 is connected to shaft 22 by a pair of braces 24 and 25. The axis 26 of levelling rod 6 extends at an angle $\alpha$ with respect to the radial direction 27. Levelling rod 6 carries a plurality of baffles 27 attached thereto at spaced locations. These baffles are preferably in the form of annular discs surrounding the levelling rod. They may of course also be of different shape. In order to counteract the tendency of the feed material to migrate radially outwardly of the sieve bottom, the planes of baffles 27 are oriented at an angle with respect to the axis 26 of levelling rod 6 so that their trailing ends are offset away from the common axis of rotation 4 in the direction of rotation 10 of sieve bottom 5. In this manner it is ensured that the feed material is displaced radially inwards on the sieve bottom on passing baffles 27.

As shown in FIG. 5, shaft 22 is rotatably mounted in bearing support 21 by means of ball bearings 30 and 31. Bearing support 21 is formed as a tubular sleeve connected to plate-shaped mounting means 20 secured to housign 2 of the cooling column by means of bolts and nuts 32 and 33, respectively. An end stub 34 of shaft 22 extends through housing wall 2 so as to project outwardly of the cooling column. Outside of the cooling tower, end stub 34 of shaft 22 carries a substantially cylindrical head portion 35 releasably attached thereto by means of a bolt 36 engaging a corresponding threaded bore 37 in end stub 34 of shaft 22. A round bar 38 is secured to head portion 35 extending therefrom preferably at right angles to the longitudinal extension of shaft 22. A substantially annular counterweight 39 is adjustably secured to round bar 38 as by means of a grub screw 40. This permits the spacing between counterweight 39 and head portion 35 to be varied so as to adjust the torque exerted by counterweight 39 on shaft 22. The angular position of round bar 38 carrying counterweight 39 relative to braces 24 and 25 connecting levelling rod 6 to shaft 22, i.e. the angle designated $\beta$ in FIG. 3, may be varied and adjusted by rotating head portion 35 to a suitable angular position with respect to shaft 22 and securing it in the selected position by means of bolt 36. Adjusting angle $\beta$ in the described manner thus permits the effective weight of the levelling rod resting on the surface of the feed material to be increased or reduced.

FIG. 6 shows a pointer 42 rigidly connected to end stub 34 of shaft 22 outside housing 2 of the cooling column. Pointer 42 preferably extends at right angles to the longitudinal extension of shaft 22. As pointer 42 is rigidly connected to shaft 22, it supplies a direct indication as to the angular position of the levelling rod and thus of the actual height of the levelling rod above the respective sieve bottom. By providing a suitably calibrated scale 43 cooperating with pointer 42 as shown in FIG. 6, it is thus possible to directly indicate the bed thickness of the feed material carried on the respective sieve bottom, for instance in centimeters.

I claim:

1. A bed thickness levelling device for a cooling column in which a feed material to be cooled or dried circulates on a plurality of sieve bottoms rotating about an axis of rotation and disposed one above the other said material being intermittently transferred onto a respective subjacent sieve bottom, comprising: a levelling rod (6); support means (21) carrying the levelling rod for oscillating movement about a stationary pivot axis parallel to the axis of the levelling rod (23) thereof said levelling rod extending substantially transversely of the direction of movement of said feed material and in its operating position resting on said feed material and being oriented in a position in which its end facing toward the axis of rotation (4) of the respective sieve bottom (5) is offset relative to the radial direction (27) of said sieve bottom in the direction of rotation (10) thereof by an angle of about 5° to 8°.

2. A device according to claim 1, wherein said levelling rod (6) is formed of a round bar or a pipe section.

3. A device according to claim 1 further comprising: a plurality of baffles (27) located on said levelling rod at spaced positions.

4. A device according to claim 3, characterized in that said baffles (27) are mounted on said levelling rod (6) in the form of annular discs.

5. A device according to claim 4, wherein the planes of said baffles (27) are inclined with respect to the travelling direction of said feed material on said sieve bottoms in a direction causing said feed material to be radially inwardly displaced on passing said baffles.

6. A device according to claim 5, further comprising: a counterweight (39) connected to said levelling rod (6) for oscillating movement together therewith about said pivot axis (23) for controlling the pressure exerted by said levelling rod on said feed material.

7. A device according to claim 6, wherein said counterweight (39) is adjustably mounted for varying its moment of torsion about said pivot axis (23).

8. A device according to claim 7, further comprising: a lever arm (39) adapted to be secured to said levelling rod mounting means (22, 24, 25) at a variable angular position ($\beta$) relative to said pivot axis (23) and said counterweight is secured to said leveler arm.

9. A device according to claim 8, further comprising: a stub (34) aligned with the pivot axis (23) of said levelling rod (6) projecting outwardly of a housing (2) of said cooling column, an indicator device (42) being connected to said stub for indicating the actual position of said levelling rod.

10. A device according to claim 9, wherein said counterweight (39) for adjusting the pressure exerted by said levelling rod on the feed material is secured to said stub (34).

11. A device according to claim 1, in which each sieve bottom comprises a plurality of circle-sector shaped sieve bottom sectors adapted to be tilted at a predetermined rotational position of the respective sieve bottom for transferring the feed material carried thereon to the subjacent sieve bottom and in which a baffle plate is provided below each upper sieve bottom at a position immediately forwards of the rotational position whereat each sieve bottom section of the respective upper sieve bottom is tilted, and further including a baffle plate extending substantially transversely of the travelling direction of said feed material, wherein the end of said baffle Plate (11) faces towards the axis of rotation (4) of said sieve bottoms (5) and is offset relative to the radial direction (27) by a predetermined angle opposite to the direction of rotation (10) of said sieve bottoms.

12. A device according to claim 11, wherein said angle ($\gamma$) is about 5° to 8°.

* * * * *